US007178183B2

(12) United States Patent
Cho

(10) Patent No.: US 7,178,183 B2
(45) Date of Patent: Feb. 20, 2007

(54) MATTRESS HAVING MATERIAL BENEFICIAL TO HUMANS AND STONE BED HAVING THE MATTRESS

(76) Inventor: Mu-Hyun Cho, 255-1 Yangjae2-dong, Seocho-gu 137-894 Seoul (KR)

( * ) Notice: Subject to any disclaimer, the term of this patent is extended or adjusted under 35 U.S.C. 154(b) by 0 days.

(21) Appl. No.: 11/023,209

(22) Filed: Dec. 22, 2004

(65) Prior Publication Data

US 2005/0229319 A1 Oct. 20, 2005

(30) Foreign Application Priority Data

Apr. 16, 2004 (KR) ..... 20-2004-0010553

(51) Int. Cl.
*A47C 21/04* (2006.01)

(52) U.S. Cl. ..... 5/421; 5/948; 607/96

(58) Field of Classification Search ..... 5/421, 5/690, 948; 607/99–100, 96
See application file for complete search history.

(56) References Cited

U.S. PATENT DOCUMENTS 5,889,923 A * 3/1999 Lee et al. ..... 392/435
6,733,436 B2 * 5/2004 Wang et al. ..... 600/9
6,899,725 B2 * 5/2005 Lee ..... 607/96
2004/0034930 A1 * 2/2004 Cho ..... 5/421

* cited by examiner

*Primary Examiner*—Patricia Engle
*Assistant Examiner*—Fredrick Conley
(74) *Attorney, Agent, or Firm*—Intellectual Property Law Group LLP; Otto O. Lee; Juneko Jackson

(57) ABSTRACT

The present invention provides a mattress having a material beneficial to humans and a stone bed having the mattress which includes a layered part that is made by sequentially layering a jade stone, slate, hardwood charcoal, a losses plate, an electromagnetic wave interceptor, the electro-heating plate, a non-woven fabric and an internal/external heat insulating material. Furthermore, a finishing part including segmental basic units, assistant units, patterning units and mixed units, which are made of materials beneficial to humans, is attached to an upper surface of the layered part of the mattress. Therefore, the present invention provides superior ventilation and is environment-friendly, thus providing elegant products of high quality to consumers.

9 Claims, 9 Drawing Sheets

B-B

MATTRESS HAVING MATERIAL BENEFICIAL TO HUMANS AND STONE BED HAVING THE MATTRESS

BACKGROUND OF THE INVENTION

1. Field of the Invention

The present invention relates generally to a mattress and a stone bed having the mattress and, more particularly, to a mattress which has a material beneficial to humans and is a kind of mat to be used in a state of being spread on a support surface, and a stone bed having the mattress.

2. Description of the Prior Art

Generally, mattresses are manufactured by thickly filling straw, cotton wool, hair or elastic materials in an outside fabric. The mattresses allow users to lie down or sit on them.

In particular, functional electric mattresses execute several functions, such as heating, massage and anion-radiating functions, using power sources for home use (110/220V, 60 Hz) to meet the convenience of the users.

Electric floor mats, mattresses for stone beds and elastic mattresses are representative examples of the above-mentioned functional electric mattresses.

Conventional functional electric mattresses use wood, such as oak, typically used in beds as mattress frames in functional electric mattresses such as those proposed in Korean Registration No. 391374, entitled 'MATTRESS-INTEGRAL STONE BED', and Korean Application No. 2003-27251, entitled 'MATTRESS', which were filed by the inventor of the present invention.

FIG. 1 illustrates an example of conventional mattress-integral stone beds.

As shown in FIG. 1, in conventional mattress-integral stone bed 1, a mattress body 20 is fastened in a mounting seat 15 of a mattress support 14 having an opening by coupling a stopper provided on an outer surface of the mattress body 20 to a stop groove formed on an inner surface of the mounting seat 15.

The mattress-integral stone bed 1 has a construction similar to those of typical beds. That is, the mattress-integral stone bed 1 includes a plurality of support legs 16 and a headboard 11 having a cushion, as do typical beds.

Each of the mattress support 14, the support legs 16 and the headboard 11 is covered with a covering material typical for beds, such as wood or leather, for graceful and dignified ornamentation of the mattress-integral stone bed 1.

Furthermore, the mattress body 20, mounted in the mattress-integral stone bed 1, has a temperature control part on a predetermined portion thereof near where a user's head is placed when the user lies on the mattress body 20 or the mattress-integral stone bed 1. A plurality of temperature control units 12 and 13 is provided in the temperature control part.

The temperature control units 12 and 13 supply external power to first and second independent electro-heating plates connected to a power supply circuit, respectively, thus independently controlling the temperature of the left and right halves of the mattress body 20.

The mattress body 20 may be manufactured as a single body. Alternatively, in consideration of manufacturing costs, the mattress body 20 may comprise a plurality of plate units 22 and 23, such as slates, which are placed on predetermined portions of an upper surface of the mattress-integral stone bed 1 other than a frame part 21.

However, an upper surface of the mattress body 20 comprising the planar plate units is very planar and sleek.

Accordingly, due to the slippery upper surface, an old or feeble person or child may be exposed to safety hazards.

Furthermore, because the mattress body 20 includes the plate units, such as slates, on the upper surface thereof, the product is perceived as cold by the user. Thus, the user may not feel a sense of closeness to the product.

In addition, in the mattress-integral stone bed 1 with the mattress body 20, because a user's skin is in surface contact with the upper surface of the planar plate units, ventilation is poor. As well, in the case that an old or feeble person or child contacts the planar plate units for several hours, skin trouble may occur on the old and feeble person or child.

Moreover, due to the warm appearance of the stone bed, users may hesitate to use the mattress-integral stone bed 1 in the summer. In addition, because the mattress-integral stone bed 1 seems unexciting to the users due to the simple arrangement of the planar plate units, the mattress-integral stone bed 1 is problematic in that the product may not arouse the customers' interest.

SUMMARY OF THE INVENTION

Accordingly, the present invention has been made keeping in mind the above problems occurring in the prior art, and an object of the present invention is to provide a mattress and a stone bed having the mattress in which a finishing part having various kinds of materials beneficial to humans is attached to an upper surface of a layered part, thus enhancing ventilation ability, being environment-friendly, and providing elegant products of high quality to consumers.

In an aspect, the present invention provides a mattress having a material beneficial to humans, including: a layered part having an electro-heating plate; a finishing part attached to an upper surface of the layered part; and a holder coupled to both the layered part and the finishing part to surround edges of both the layered part and the finishing part. The finishing part has a plurality of segmental basic units each having a shape of a rectangular block, a fragment, a piece or a narrow strip; and assistant units made of the materials beneficial to humans and interposed between the segmental basic units to form a predetermined pattern;

In another aspect, the present invention provides a mattress-integral stone bed having a material beneficial to humans, including: a mattress, having a layered part having an electro-heating plate, a finishing part attached to an upper surface of the layered part, and a holder coupled to both the layered part and the finishing part to surround edges of both the layered part and the finishing part; and a frame part, having a stop groove to engage with a stopper of the holder, a mat mounting seat in which the stop groove is formed, a mat support on which the mat mounting seat is provided at a central portion of the mat support, and a support leg attached to a lower surface of the mat support. The finishing part of the mattress has a plurality of segmental basic units each having a shape of a rectangular block, a fragment, a piece or a narrow strip; and assistant units made of the materials beneficial to humans and interposed between the segmental basic units to form a predetermined pattern.

In a further aspect, the present invention provides a mattress-integral stone bed having a material beneficial to humans, including: a mattress having a layered part having an electro-heating plate, a finishing part which is attached to an upper surface of the layered part and has a plurality of mixed units, and a holder coupled to both the layered part and the finishing part to surround edges of both the layered part and the finishing part; and a frame part having a stop groove to engage with a stopper of the holder, a mat mounting seat in which the stop groove is formed, a mat support on which the mat mounting seat is provided at a central portion of the mat support, and a support leg attached to a lower surface of the mat support. Each of the mixed units of the finishing part has a rectangular plate having predetermined thickness, length and width; and a plurality of reception grooves longitudinally formed on an upper surface of the rectangular plate and spaced apart from each other in a later direction at predetermined intervals, with powder filled in the reception grooves in a state of being mixed with a UV (ultraviolet) emitting material to radiate waves beneficial to humans, thus forming a first coating layer in each of the mixed units.

DETAILED DESCRIPTION OF THE SPECIFIC EMBODIMENTS

Figure 1:
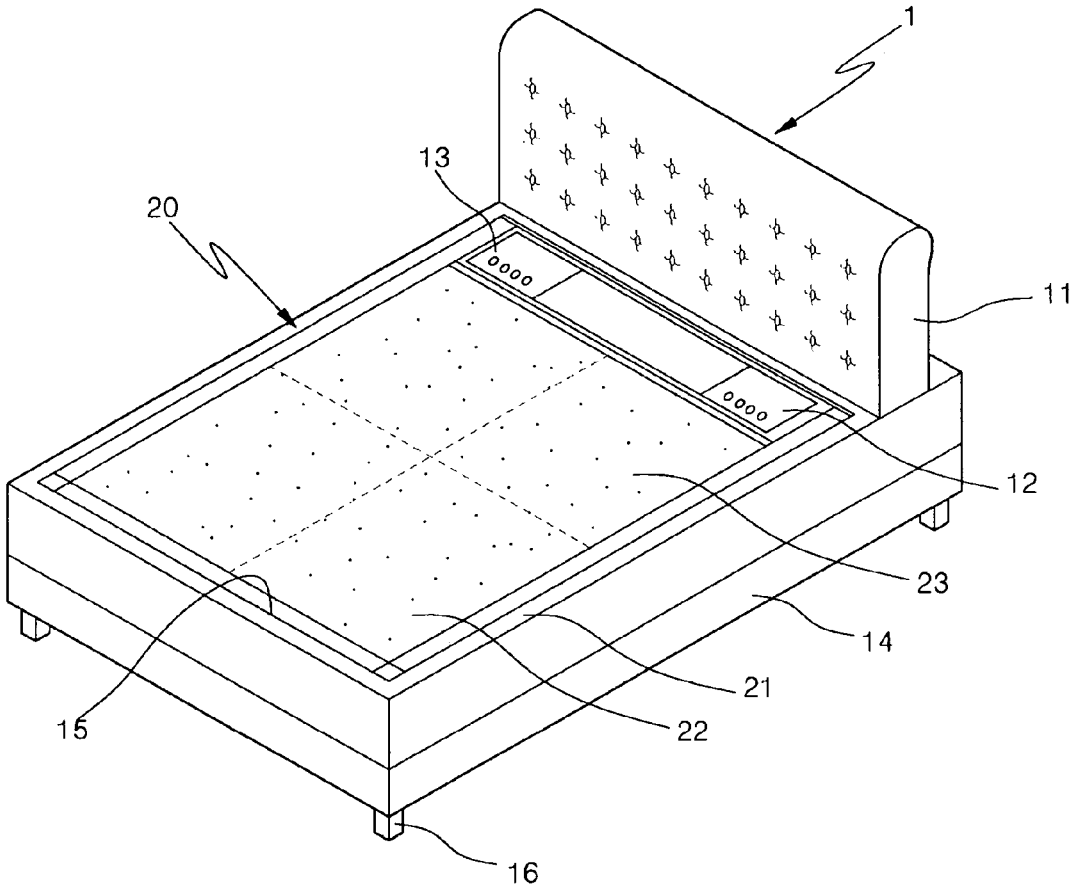
FIG. 1 is a perspective showing a conventional stone bed with a mattress.

The above and other objects, features and construction of the present invention will be more clearly understood from the following detailed description taken in conjunction with the accompanying drawings. Reference now should be made to the drawings, in which the same reference numerals are used throughout the different drawings to designate the same or similar components.

Figure 2:
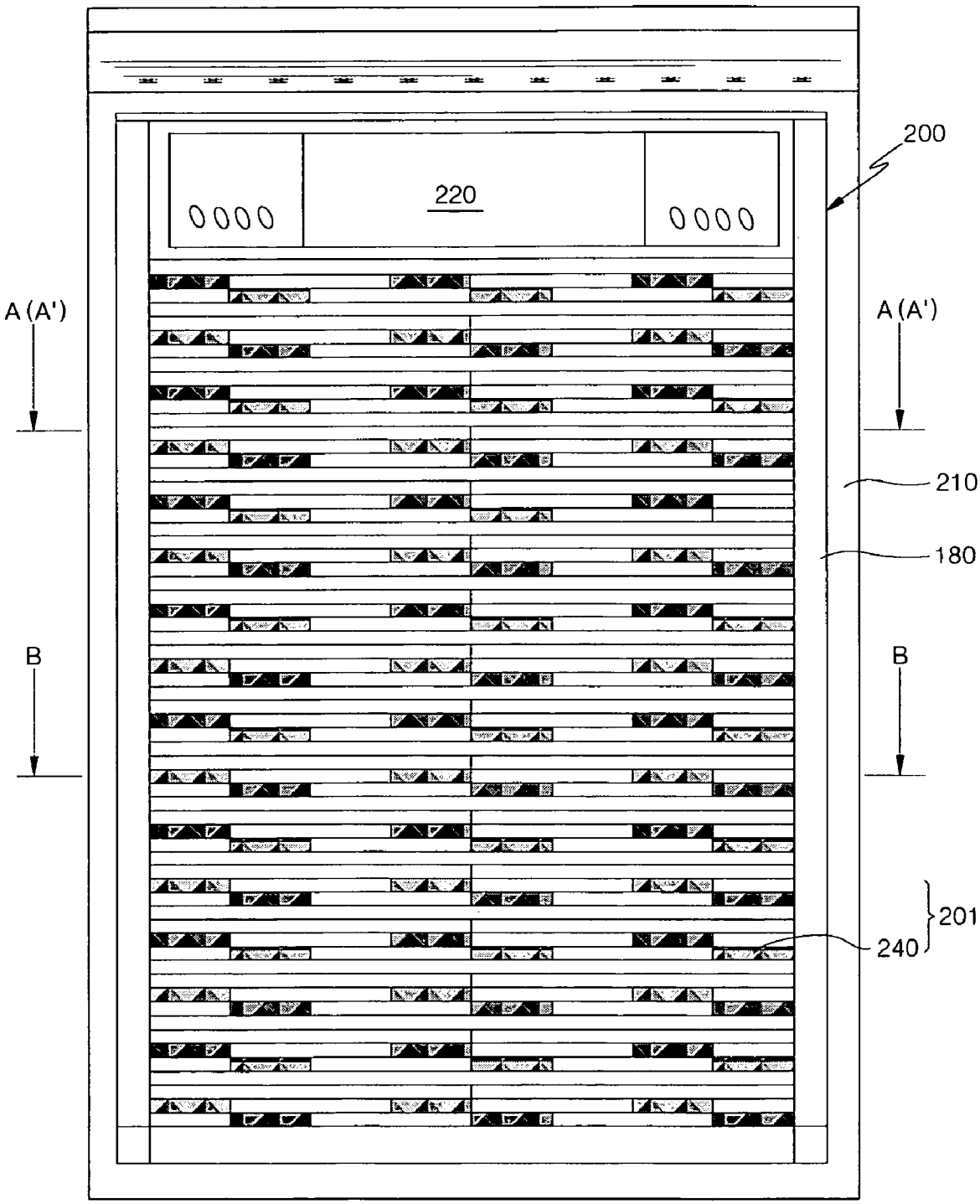
FIG. 2 is a plan view to illustrate a mattress having a material beneficial to humans and a stone bed having the mattress, according to a first embodiment of the present invention.

As shown in FIG. 2, a mattress 200 according to the first embodiment of the present invention has a structure capable of being independently used in the case of being removed from a frame part 210. On the other hand, when the mattress 200 is coupled to the frame part 210, a mattress-integral stone bed is provided.

Figure 7A:
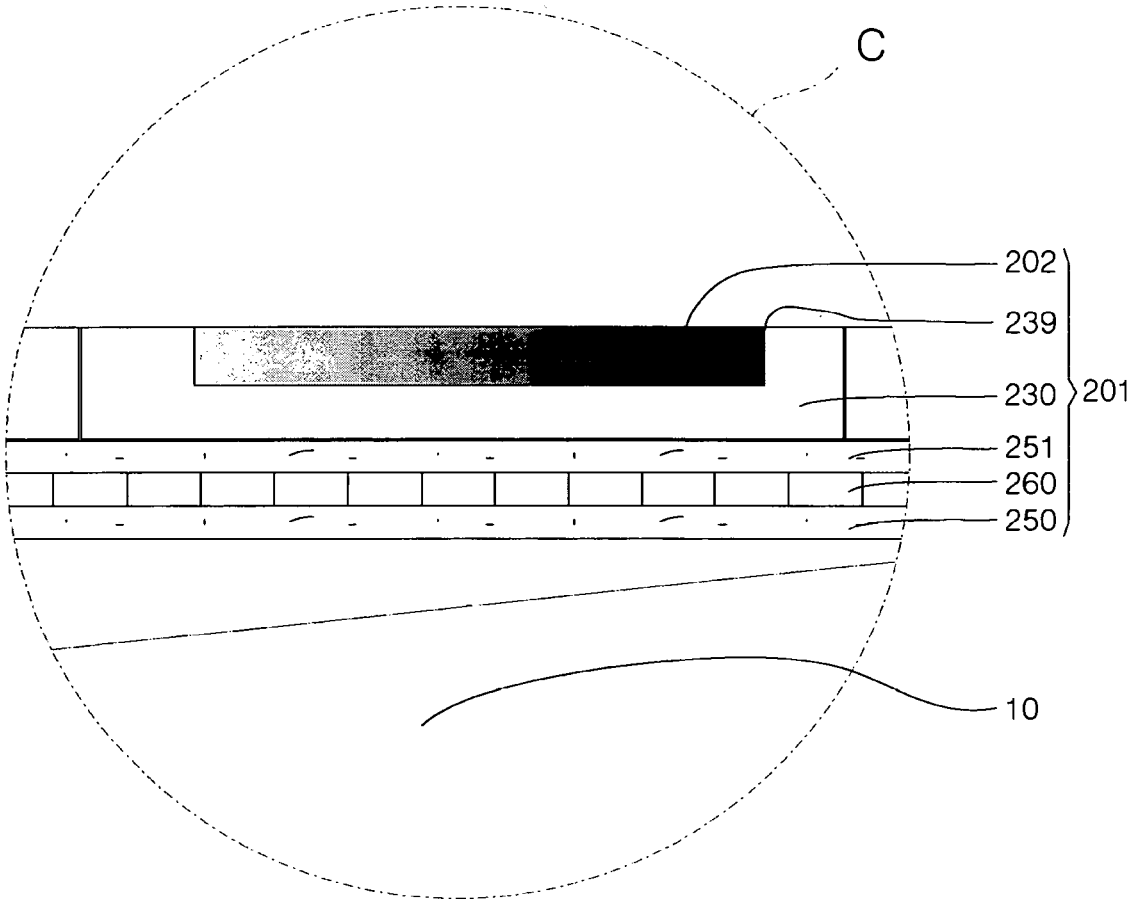
FIG. 7A is an enlarged sectional view of a circled portion 'C' of FIG. 6.
Figure 7B:
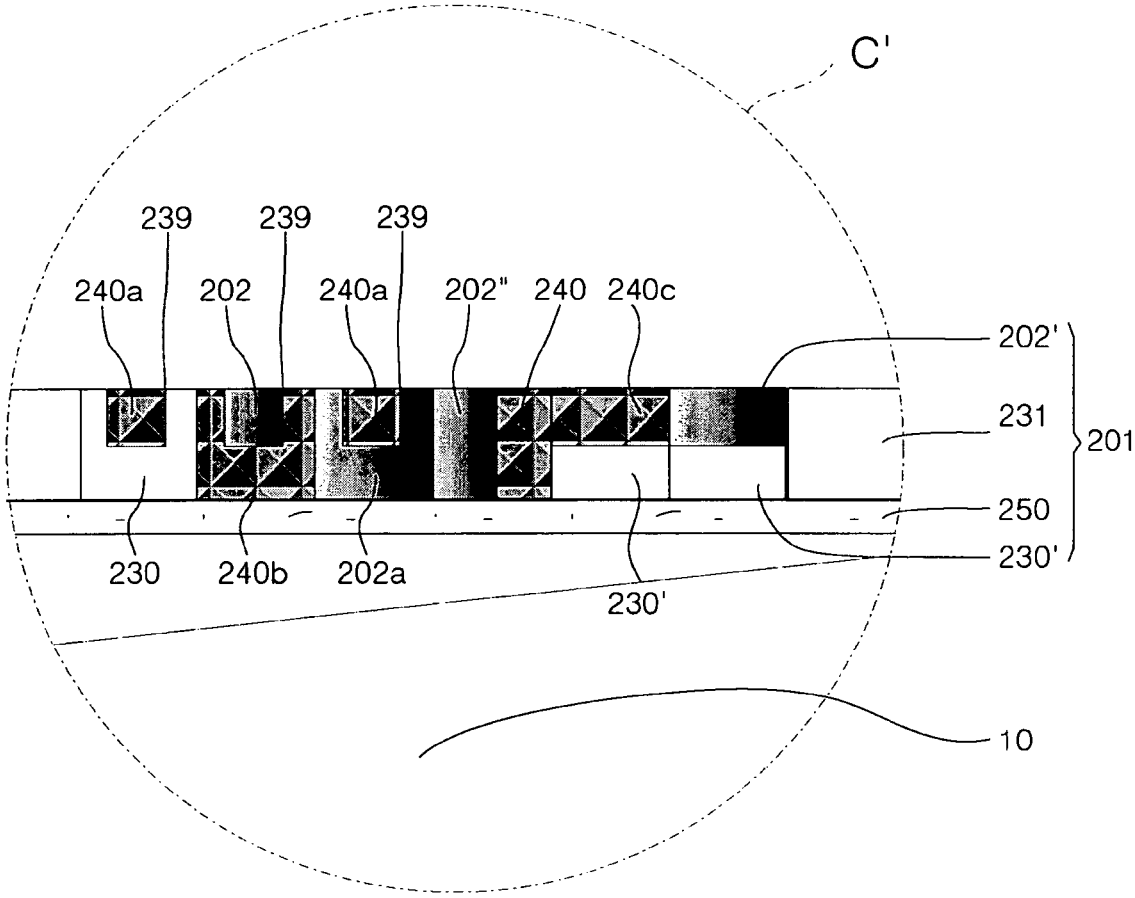
FIG. 7B is an enlarged sectional view of a circled portion 'C' of FIG. 6 to show a modification of the second embodiment of the present invention.
Figure 8:
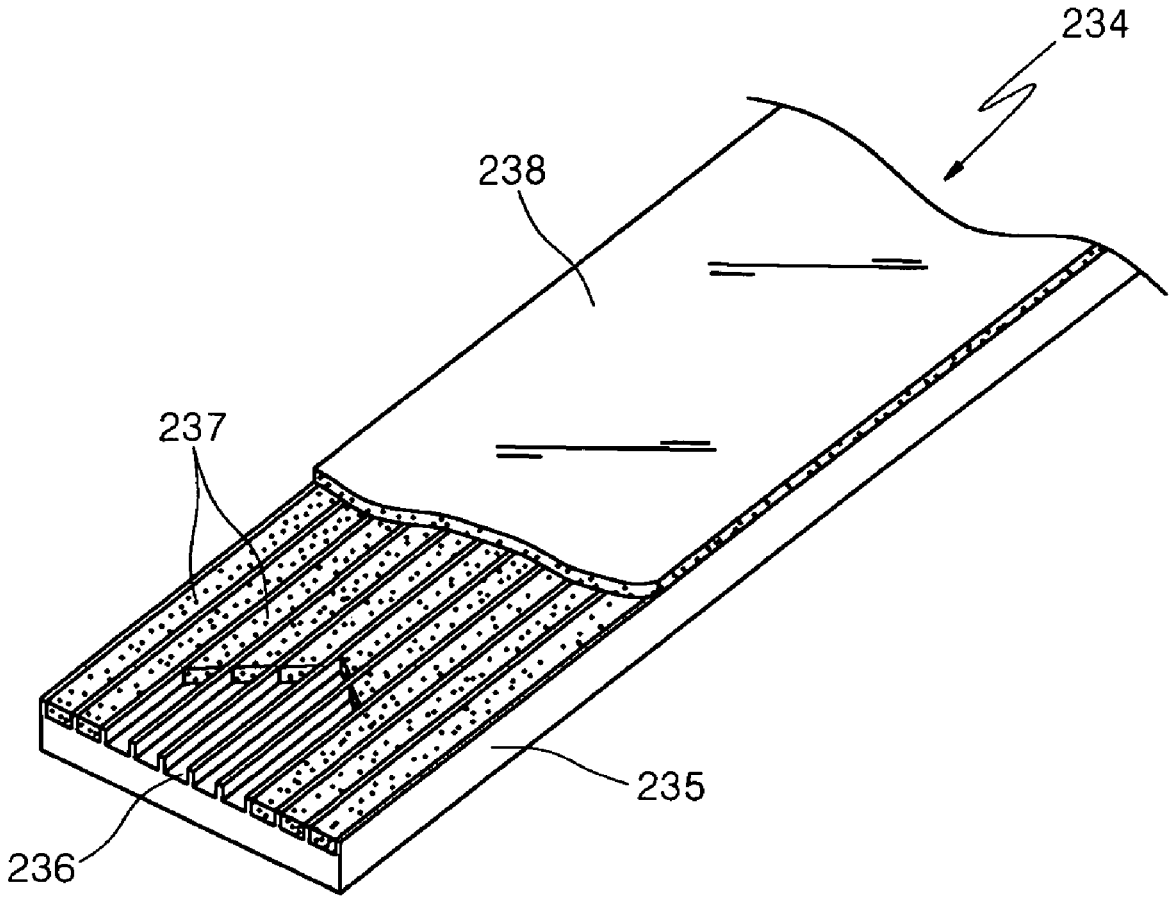
FIG. 8 is an enlarged perspective view showing a mixed unit used in the mattress and the stone bed of the present invention.

A finishing part 201, which serves as a finishing material in the present invention, includes a plurality of segmental basic units 230, a plurality of assistant units 240, various patterning units 202, 202', 202" and 202*a* (see, FIGS. 6, 7A and 7B), and a plurality of mixed units 234 (see, FIG. 8).

Each of the segmental basic units 230 is made of wood, such as oak, bamboo or maple.

The assistant units 240 are interposed between the segmental basic units 230 and each are made of a material beneficial to humans which will be explained later herein in detail.

The patterning units 202, 202', 202" and 202*a* serve to express predetermined patterns, designs, product logos or figures.

Each of the mixed units 234 is made by combining wood and another material beneficial to humans which are the same as those used for the segmental basic unit 230 and the assistant unit 240, respectively. The mixed unit 234 will be described later herein in detail.

The above-listed finishing materials cover the upper surface of the mattress 200 except for the frame part 210 and the temperature control part 220.

The temperature control part 220 electrically controls an electro-heating plate which is provided inside the frame part 210.

The finishing materials, such as the segmental basic units 230, the assistant units 240, the patterning units 202, 202', 202" and 202*a*, and the mixed units 234 constituting the finishing part 201, are all segmental.

In the present invention, segmentation means that each of the segmental basic units 230, the assistant units 240, the patterning units 202, 202', 202" and 202*a* and the mixed units 234 is processed into a shape of a rectangular block, a fragment, a piece or a narrow strip, thus being modularized to provide an assembled structure similar to a block arrangement.

The segmental basic units 230 and the assistant units 240 form a predetermined pattern as follows.

For example, the segmental basic units 230 and the assistant units 240 form a random pattern or a regular pattern including a square, a diamond shape, a circle, a triangle, a reverse triangle, a stair shape or a trapezium, according to their arrangement on the upper surface of the mattress 200.

The segmental basic units 230 and the assistant units 240 are fastened to predetermined positions on the upper surface of the mattress 200 inside the frame part 210 by a holder 180 or a bonding agent, as follows.

Preferably, each of the assistant units 240 is made of one selected from the group consisting of jade, loess, charcoal, elvan, jewels including crystal and agate, and handiwork including nacre and carved animal horn.

In the additional description, each of the assistant units 240 comprises a handiwork including nacre and carved animal horn, jewels including jade, crystal and agate, semi-jewels, a raw rock, such as biotite or elvan, or a processed material made by compress-forming (coating) powder of the above-mentioned materials, loess or charcoal.

Hereinafter, with reference to FIGS. 3 through 5, the coupling of the finishing part 201 including the plurality of segmental basic units 230, 231, 232, 233 and the assistant units 240 to the mattress 200 will be described.

Figure 3:
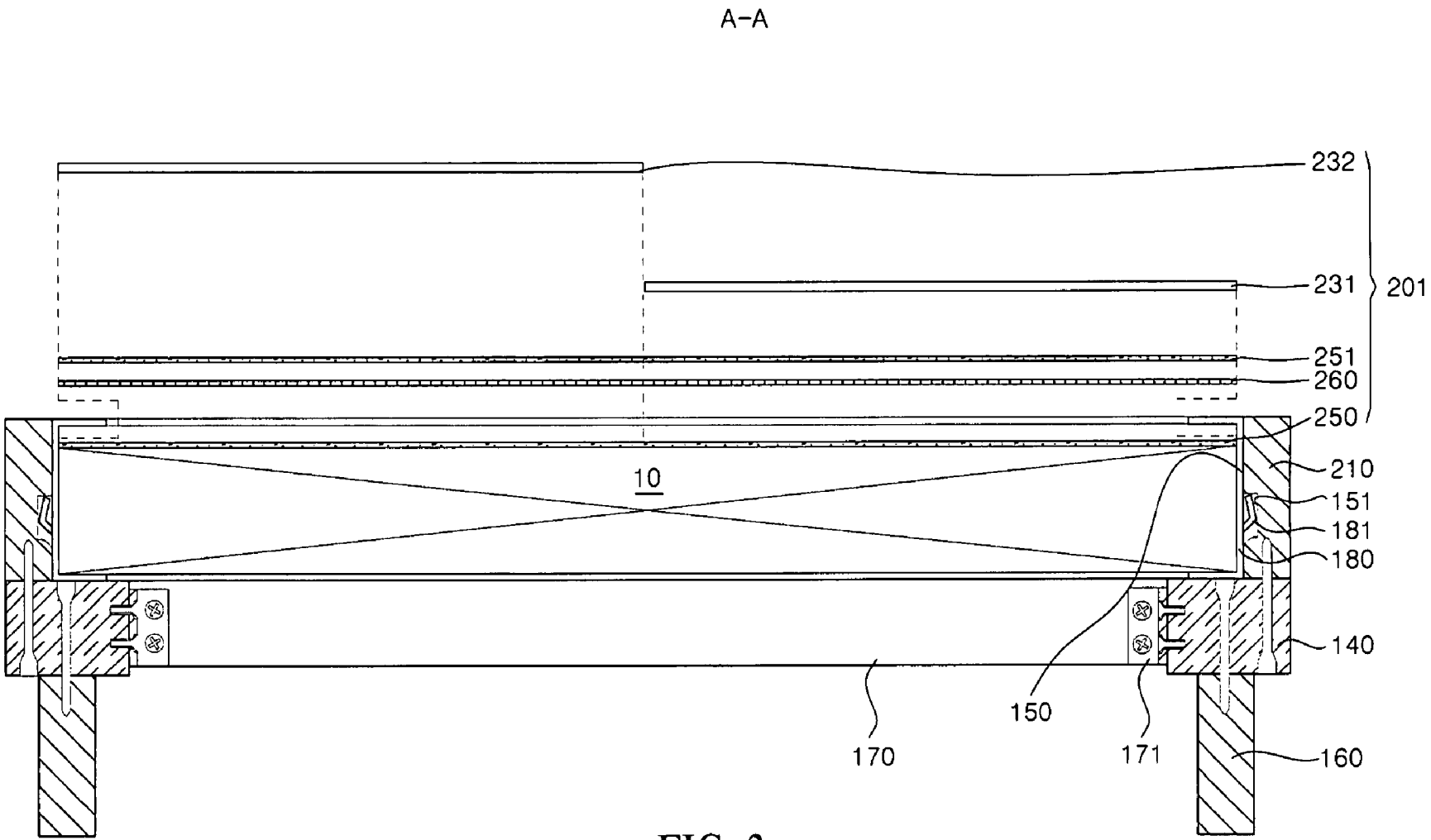
FIG. 3 is a sectional view taken along the line A—A of FIG. 2.

FIG. 3 is a sectional view taken along the line A-A of FIG. 2.

Referring to FIG. 3, in the first embodiment, each of a mat support 140 and the frame part 210, which is supported on the mat support 140, is made of wood.

A plurality of support legs 160 is fastened to a lower surface of the mat support 140 by stud bolts.

A plurality of latitudinal supports 170 is coupled to the mat support 140 in a central portion of the mat support 140 by fastening units 171, such as L-shaped cramps, locking bolts and rivets to support a layered part 10 of the mattress 200 thereon.

A mat mounting seat 150 having an opening is provided inside the frame part 210 to receive therein the holder 180 in an upward direction.

At this time, preferably, a plurality of stop grooves 151 is formed on an inner wall of the mat mounting seat 150.

Stoppers 181 protrude outwards at predetermined positions on an outer surface of the holder 180 to correspond to the stop grooves 151 of the mat mounting seat 150.

Each of the stoppers 181 engage with each of the stop grooves 151.

The holder 180 is inserted into the mat mounting seat 150 having the through structure inside the frame part 210. Preferably, the holder 180 has a rectangular ring shape and a U-shaped cross-section.

The layered part 10 of the mattress 200 is a filling material for stone beds, which is made by sequentially layering a jade stone, a slate, a hardwood charcoal, a losses plate, an electromagnetic wave interceptor, the electro-heating plate, a non-woven fabric and an internal/external heat insulating material.

The finishing part 201 has a predetermined regular pattern by engaging the plurality of segmental basic units 231 and 232 and the assistant units 240 together in any horizontal direction. Furthermore, the finishing part 201 has the same surface area as that of the layered part 10.

A typical bonding agent is applied to an upper surface of the layered part 10 to form a first bonding layer 250. An adhesive fabric 260 is layered on the first bonding layer 250. A second bonding layer 251 is applied on the adhesive fabric 260. The finishing part 201 is layered on the second bonding layer 251, thus being fastened to the layered part 10.

A bonding agent used for the first and second bonding layer 250 and 251 of the present invention may comprise a one-component or two-component (in which the main ingredient and hardener are separated from each other) bonding epoxy used in the engineering and construction industry. Alternatively, the bonding agent used for the first and second bonding layer 250 and 251 may comprise an industrial bonding agent which is useful in bonding almost all industrial materials as well as wood and stone.

Both the layered part 10 and the finishing part 201, which are assembled together through the above-mentioned process, are coupled to the holder 180 which surrounds edges of both the layered part 10 and the finishing part 201. Of course, a bonding agent may be used to reinforce the coupling of both the layered part 10 and the finishing part 201 to the holder 180.

Figure 4:
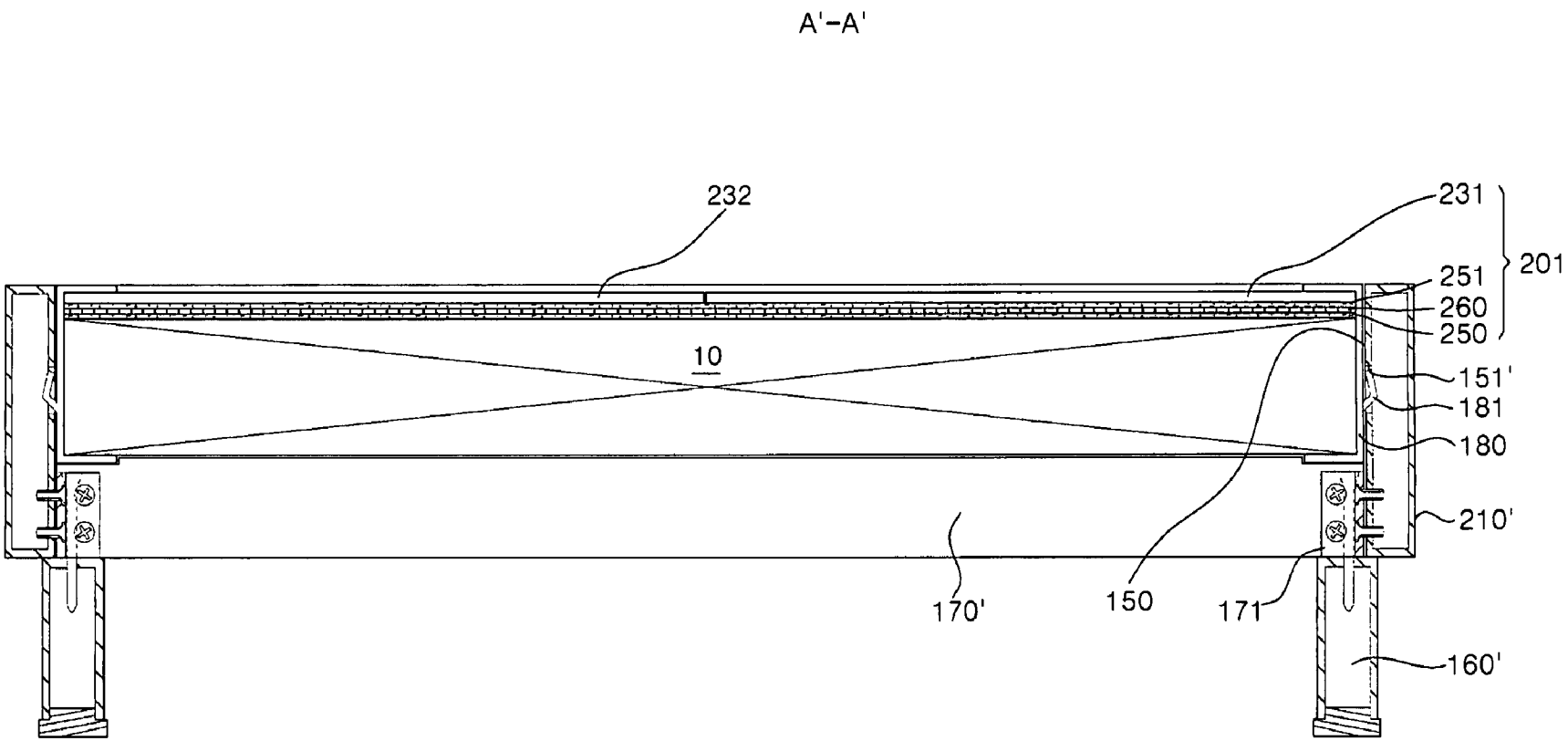
FIG. 4 is a sectional view taken along the line A'—A' of FIG. 2 to show a modification of the first embodiment of the present invention.

FIG. 4 is a sectional view taken along the line A'—A' of FIG. 2 to show a modification of the first embodiment of the present invention.

Referring FIG. 4, in a mattress-integral stone bed according to the modification of the first embodiment of the present invention, a plurality of support legs 160', a plurality of latitudinal supports 170', a frame part 210' having a function of supporting the mat, and a holder 180 each are made of nonferrous metals including aluminum, alloy of the nonferrous metals, or a high density fiber-reinforced composite material. Preferably, each of the above-mentioned parts is hollow for reduction in weight and is covered with a covering material, such as leather, for an external ornamentation of the stone bed.

In the mattress-integral stone bed according to the modification of the first embodiment, a finishing part 201 is attached to an upper surface of a layered part 10 by a bonding agent and, alternatively, they may be held together by the holder 180.

Figure 5:
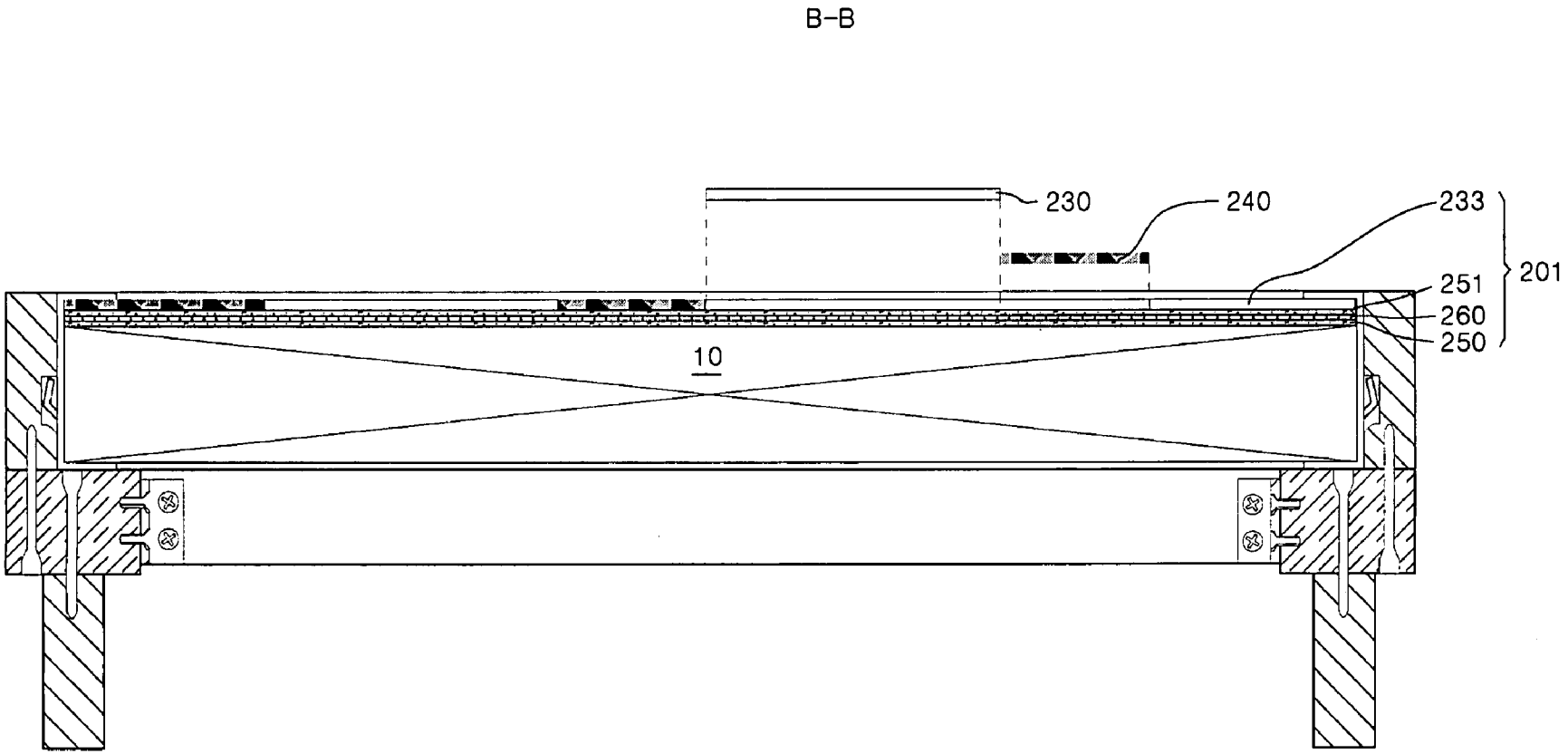
FIG. 5 is a sectional view taken along the line B-B of FIG. 2.

Referring to FIG. 5, the assistant units 240 of the finishing part 201 of the first embodiment are interposed between the segmental basic units 230, 233.

Preferably, the size, type and shape of each of the assistant units 240 and the segmental basic units 230, 233 are determined according to a predetermined pattern which was decided in advance in consideration of the design of the mattress-integral stone bed.

Each of the assistant units 240 and the segmental basic units 230, 233 has the shape of a segment, a section or a block.

The assistant units 240 and the segmental basic units 230 and 233 are arranged to be in close contact with each other, and fine gaps are formed between edges opposite to each other.

The fine gags between the assistant units 240 and the segmental basic units 230, 233 serve as paths for ventilation of the finishing part 201. The present invention has superior ventilation.

Figure 6:
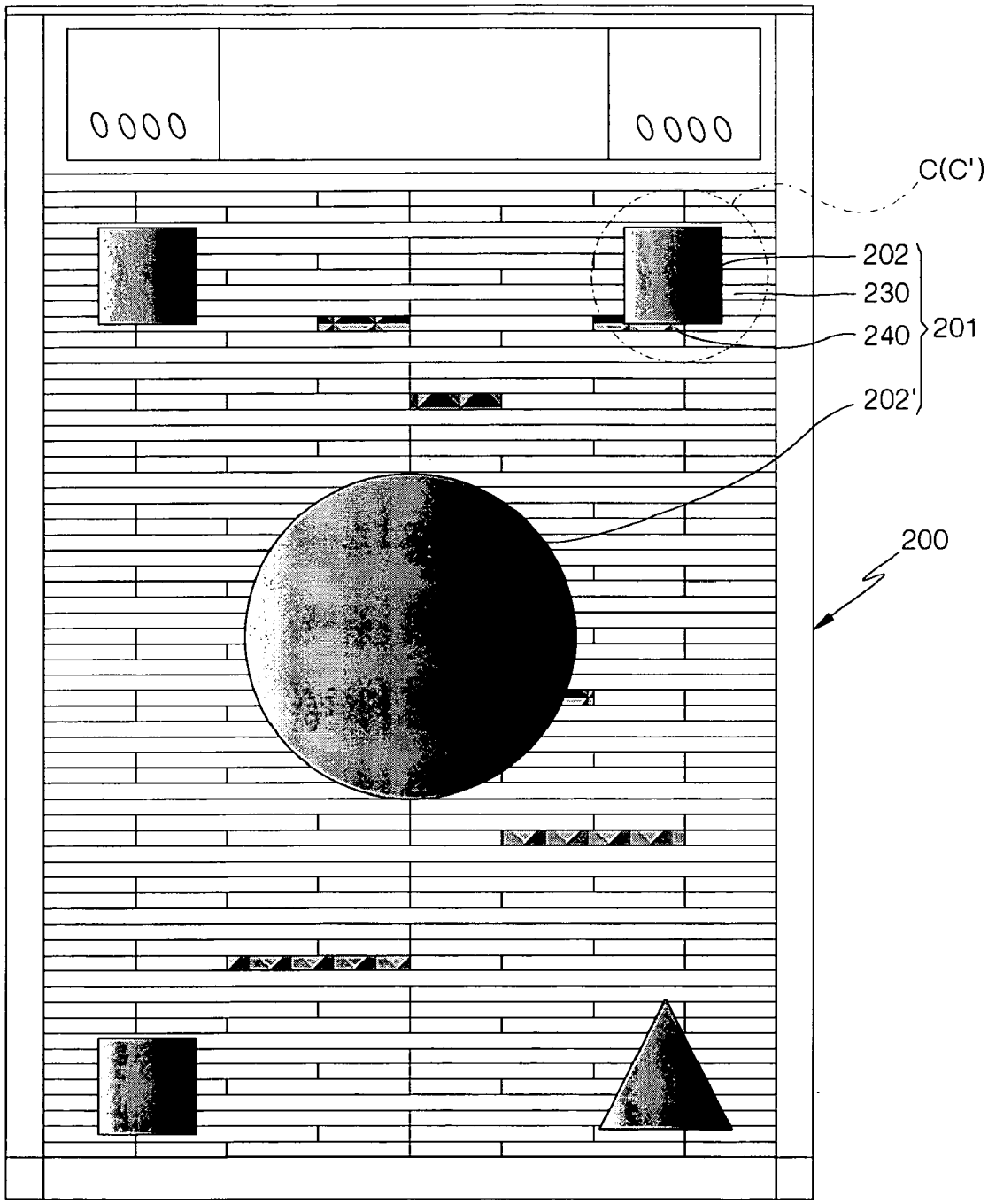
FIG. 6 is a plan view of a mattress having a material beneficial to humans, according to a second embodiment of the present invention.

FIG. 6 is a plan view of a mattress 200 having a material beneficial to humans, according to a second embodiment of the present invention.

As shown in FIG. 6, in the mattress 200 according to the second embodiment, a finishing part 201 having a plurality of assistant units 240 and a plurality of segmental basic units 230 includes a plurality of patterning units 202 and 202'. Each of the patterning units 202 and 202' is provided with a product logo, a pattern, an image, a character, a brand, or a mark including a letter, a numeral and a sign.

In other words, the patterning units 202 and 202' constitute the finishing part 201. The pattering units 202 and 202' may be provided at several positions on the finishing part 201, for example, on a central portion or corners of the finishing part 201. The sizes, shapes and number of patterning units 202 and 202' may change according to the product, and thus, are not limited to the explanation in the present invention.

FIG. 7A is an enlarged sectional view of a circled portion 'C' of FIG. 6.

As shown in FIG. 7A, in the second embodiment, a first bonding layer 250 of the finishing part 201, an adhesive fabric 260, a second bonding layer 251 and one of a plurality of segmental basic units 230 or a plurality of assistant unit are sequentially layered on an upper surface of a layered part 10.

In particular, the segmental basic units 230 have insert grooves 239 on their upper surfaces.

Here, each patterning unit 202 has a layout corresponding to a volume of each of the insert grooves 239, such that the patterning unit 202 is inserted in the insert groove 239 of the segmental basic units 230 to be leveled with upper surfaces of the segmental basic units 230.

FIG. 7B is an enlarged sectional view of a circled portion 'C'' of FIG. 6 to show a modification of the second embodiment of the present invention.

As shown in FIG. 7B, in the modification of the second embodiment, an upper surface of a finishing part 201 is coated with a UV (ultraviolet) emitting material.

Various patterning units 202, 202', 202" and 202*a*, a plurality of segmental basic units 230, 230' and 231 and a plurality of assistant units 240, 240*a*, 240*b* and 240*c* are arranged under the UV emitting material.

At this time, preferably, the thickness of each of the segmental basic unit 230', the patterning unit 202' and the assistant unit 240*c* is thinner than that of the segmental basic unit 231, so that the thickness of a layer, in which the patterning unit 202' is layered on the segmental basic unit 230', and a thickness of a layer, in which the assistant unit 240*c* is layered on the segmental basic unit 230', both correspond to the thickness of the segmental basic unit 231. In this case, an upper surface of the segmental basic unit 231 can be level with an upper surface of the patterning unit 202' without the above-mentioned insert groove 239. Thus, a production of the patterning unit 202' is simplified.

Furthermore, the patterning unit 202" and the assistant unit 240 are vertically arranged one after another to be separated or assembled in the direction of either the width or the length of the segmental basic unit 231.

Each of the patterning unit 202*a*, the assistant unit 240*b* and the segmental basic unit 231 has an insert groove 239 on a central portion thereof. The assistant 240*a* or the patterning unit 202 is inserted into the insert groove 239 of each of the patterning unit 202*a*, the assistant unit 240*b* and the segmental basic unit 231.

In the modification of the second embodiment, the patterning unit 202*a*, the assistant unit 240*b* and the segmental basic unit 231, which each have the insert groove 239, the patterning unit 202" and the assistant unit 240, which are vertically arranged one after another, and the segmental basic unit 230' each may be attached to the layered part 10 by a first bonding layer 250 without a separate adhesive fabric, in a manner similar to or somewhat different from that of the second embodiment.

As shown in FIG. 8, each of the mixed units 234, except for the reception grooves 236, has a layout and an attachment structure similar to those of the segmental basic unit.

Each of the mixed units 234 is layered on the above-mentioned second bonding layer of the finishing part.

Each of the mixed units 234 includes a rectangular plate 235 which has a predetermined thickness, length and width. Each of the mixed units 234 further includes the plurality of reception grooves 236 which are longitudinally formed on an upper surface of the rectangular plate 235 to be spaced apart from each other in a lateral direction at predetermined intervals.

Powder 237 is filled in the reception grooves 236 in a state of being mixed with a UV emitting material to radiate waves, such as far infrared rays, beneficial to humans, thus forming a first coating layer in each of the mixed units 234.

Preferably, the powder 237, filled in the reception grooves 236 in the state of being mixed with the UV emitting material, comprises one selected from the group consisting of jade powder, elvan powder, germanium powder, powder of jewels including crystal and agate, nacre powder, powder of animal horn, biotite powder, loess powder and charcoal powder.

Furthermore, a transparent or translucent UV coating layer is applied to an outer surface of the first coating layer, that is, an upper surface of the rectangular plate 235 to protect the first coating layer, thus forming a second coating layer 238 in each of the mixed units 234.

As such, because the powder 237 beneficial to humans is integrated with the rectangular plate 235 which is made of wood and is coated with the first and second coating layers, the mixed unit 234 serves to promote good health and to prevent disease in adults. As well, because the second coating layer 238 is transparent or translucent, the user can observe the materials (powder, wood) beneficial to humans with the naked eye.

As described above, the present invention provides a mattress having a material beneficial to humans and a stone bed having the mattress in which assistant units and/or patterning units, made of the material beneficial to humans, are interposed between segmental basic units, thus enhancing ventilation ability, being environment-friendly, and providing elegant products of high quality to consumers.

Furthermore, in the mattress having the material beneficial to humans and the stone bed having the mattress, a frame part is made of wood and is hollow for reduction in weight. Therefore, a pattern of a finishing part is diversified to be suitable for designs of various stone beds or fancy mattresses.

In addition, the stone bed provided with the mattress having the material beneficial to humans has a holder which fastens the finishing part, including the segmental basic units, the assistant units and the patterning units, and a layered part, which supports the finishing part thereon, to the frame part. Accordingly, the stone bed of the present invention has superior durability and bonding power, compared with conventional products having simple bonding arrangement.

Moreover, in the mattress having the material beneficial to humans and the stone bed having the mattress, powder beneficial to humans is integrated with the unit, which is made of wood, prior to being coated with a transparent or translucent layer, thus being conducive to health and preventing adult disease. As well, a user can observe the materials (powder, wood) beneficial to humans with the naked eye.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A mattress having a material beneficial to humans, comprising:

(a) a layered part having an electro-heating plate;

(b) a finishing part attached to an upper surface of the layered part; and (c) a holder coupled to both the layered part and the finishing part to surround edges of both the layered part and the finishing part, wherein the finishing part comprises a plurality of segmental basic units each having a shape of a rectangular block, a fragment, a piece or a narrow strip;

a plurality of assistant units made of the materials beneficial to humans and interposed between the segmental basic units to form a predetermined pattern; and a patterning unit provided with a product logo, a pattern, an image, a character, a brand, or a mark including a letter, a numeral or a sign, and inserted into an insert groove of each of the segmental basic units or each of the assistant units to be level with an upper surface of the segmental basic unit or the assistant unit.

2. A mattress having a material beneficial to humans, comprising:

(a) a layered part having an electro-heating plate;

(b) a finishing part attached to an upper surface of the layered part; and (c) a holder coupled to both the layered part and the finishing part to surround edges of both the layered part and the finishing part, wherein the finishing part comprises a plurality of segmental basic units each having a shape of a rectangular block, a fragment, a piece or a narrow strip;

a plurality of assistant units made of the materials beneficial to humans and interposed between the segmental basic units to form a predetermined pattern; and a plurality of mixed units, each of the mixed units comprising:

a rectangular plate having a predetermined thickness, length and width; and a plurality of reception grooves longitudinally formed on an upper surface of the rectangular plate to be spaced apart from each other at predetermined intervals in a lateral direction, with powder, comprising one selected from the group consisting of jade powder, elvan powder, germanium powder, powder of jewels including crystal and agate, nacre powder, powder of animal horn, biotite powder, loess powder and charcoal powder, filled in the reception grooves in a state of being mixed with a UV (ultraviolet) emitting material to radiate waves beneficial to humans, thus forming a first coating layer in each of the mixed units.

3. A mattress-integral stone bed having a material beneficial to humans, comprising:

(a) a mattress, comprising:

a layered part having an electro-heating plate;

a finishing part attached to an upper surface of the layered part; and a holder coupled to both the layered part and the finishing part to surround edges of both the layered part and the finishing part; and (b) a frame part, comprising:

a stop groove to engage with a stopper of the holder;

a mat mounting seat in which the stop groove is formed;

a mat support on which the mat mounting seat is provided at a central portion of the mat support; and a support leg attached to a lower surface of the mat support, wherein the finishing part comprises:

a plurality of segmental basic units each having a shape of a rectangular block, a fragment, a piece or a narrow strip; and a plurality of assistant units made of the materials beneficial to humans and interposed between the segmental basic units to form a predetermined pattern.

4. The mattress-integral stone bed as set forth in claim 3, wherein each of the assistant units is made of one selected from the group consisting of jade, loess, charcoal, elvan, jewels including crystal and agate, and a handiwork including a nacre or a carved animal horn.

5. The mattress-integral stone bed as set forth in claim 3, wherein each of the segmental basic units is made of wood, such as oak, bamboo and maple.

6. The mattress-integral stone bed as set forth in claim 3, wherein each of the holder of the mattress and the frame part comprising the mat support, the support leg and a latitudinal support is made of wood, nonferrous metals including aluminum, alloy of the nonferrous metals, or a high density fiber reinforced composite material.

7. The mattress-integral stone bed as set forth in claim 3, wherein each of the holder of the mattress and the frame part comprising the mat support, the support leg and a latitudinal support is hollow and is covered with a covering material, such as leather, for external ornamentation of the stone bed.

8. A mattress-integral stone bed having a material beneficial to humans, comprising:

(a) a mattress, comprising:

a layered part having an electro-heating plate;

a finishing part attached to an upper surface of the layered part and comprising a plurality of mixed units; and a holder coupled to both the layered part and the finishing part to surround edges of both the layered part and the finishing part; and (b) a frame part, comprising:

a stop groove to engage with a stopper of the holder;

a mat mounting seat in which the stop groove is formed;

a mat support on which the mat mounting seat is provided at a central portion of the mat support; and support leg attached to a lower surface of the mat support, wherein each of the mixed units comprising:

a rectangular plate having predetermined thickness, length and width; and a plurality of reception grooves longitudinally formed on an upper surface of the rectangular plate and spaced apart from each other in a later direction at predetermined intervals, with powder filled in the reception grooves in a state of being mixed with a UV (ultraviolet) emitting material to radiate waves beneficial to humans, thus forming a first coating layer in each of the mixed units.

9. The mattress-integral stone bed as set forth in claim 8, wherein the powder comprises one selected from the group consisting of jade powder, elvan powder, germanium powder, powder of jewels including crystal and agate, nacre powder, powder of animal horn, biotite powder, loess powder and charcoal powder.

* * * * *